US006263984B1

(12) United States Patent
Buckman, Sr.

(10) Patent No.: US 6,263,984 B1
(45) Date of Patent: Jul. 24, 2001

(54) METHOD AND APPARATUS FOR JET DRILLING DRAINHOLES FROM WELLS

(76) Inventor: William G. Buckman, Sr., 504 Memphis Junction Rd., Bowling Green, KY (US) 42101

( * ) Notice: Subject to any disclaimer, the term of this patent is extended or adjusted under 35 U.S.C. 154(b) by 0 days.

(21) Appl. No.: 09/480,170

(22) Filed: Jan. 10, 2000

Related U.S. Application Data

(60) Provisional application No. 60/143,316, filed on Jul. 12, 1999, and provisional application No. 60/120,731, filed on Feb. 18, 1999.

(51) Int. Cl.[7] ..... E21B 7/18
(52) U.S. Cl. ..... 175/67; 175/45; 175/424
(58) Field of Search ..... 175/45, 62, 61, 175/67, 26, 27, 424

(56) References Cited

U.S. PATENT DOCUMENTS

| | | | |
|---|---|---|---|
| 1,865,853 | | 7/1932 | Granville . |
| 3,130,786 | | 4/1964 | Brown et al. . |
| 3,145,776 | | 8/1964 | Pittman . |
| 3,191,697 | | 6/1965 | Haines . |
| 3,234,723 | | 2/1966 | Brown . |
| 3,853,185 | | 12/1974 | Dahl et al. . |
| 3,924,698 | | 12/1975 | Juvkam-Wold . |
| 3,960,407 | | 6/1976 | Noren . |
| 4,050,529 | | 9/1977 | Tagirov et al. . |
| 4,119,160 | | 10/1978 | Summers et al. . |
| 4,134,453 | | 1/1979 | Love et al. . |
| 4,317,492 | | 3/1982 | Summers et al. . |
| 4,346,761 | | 8/1982 | Skinner et al. . |
| 4,368,786 | | 1/1983 | Cousins . |
| 4,497,381 | | 2/1985 | Dickinson, III et al. . |
| 4,533,182 | | 8/1985 | Richards . |
| 4,640,362 | | 2/1987 | Schellstede . |
| 4,821,961 | | 4/1989 | Shook . |
| 4,826,087 | * | 5/1989 | Chinery ..... 239/551 |
| 4,848,486 | | 7/1989 | Bodine . |
| 4,852,668 | | 8/1989 | Dickinson, III et al. . |
| 4,896,733 | * | 1/1990 | Baker et al. ..... 175/26 |
| 4,957,173 | | 9/1990 | Kinnan . |
| 5,113,953 | | 5/1992 | Noble . |
| 5,148,877 | | 9/1992 | MacGregor . |
| 5,148,880 | | 9/1992 | Lee et al. . |

(List continued on next page.)

OTHER PUBLICATIONS

"The Leader in High–Pressure Water Jet Technology" NCLB Corp Water jetting Nozzle Catalog., pp. 1–3, 62–63 (Jan. 1998).

Mauer, "Novel Drilling Techniques", Pergamon Press, pp. 38–45 & 96–97 (1968).

D. A. Summers, et al., Diajet Use in an Environmental Application, pp. 1–10 was presented to the 11th International Conference on Jet Cutting Technology, St. Andrews, Scotland, (Sep. 8–10, 1992).

Pendleton, et al., "Bechtel develops innovative method for horizontal drilling" *Technology Oil & Gas Journal* pp. 95–99, (May 27, 1985).

*Primary Examiner*—Frank Tsay
(74) *Attorney, Agent, or Firm*—Baker Botts L.L.P.

(57) ABSTRACT

Nozzle jet drill bits for drilling drainholes from a wellbore are provided in a 4 ½-inch or larger casing. The drills are small enough to allow use of a bit diverter to turn the bits about 90 degrees in the casing when attached to an elastomeric high-pressure tube. Pumping of fluid, which may contain abrasive particles, through the bits allows drilling though the wall of casing, if present, and continued drilling into a formation surrounding the well without withdrawing the bit from the well. Direction-indicating instruments and geophones may be used to measure or monitor direction and location of the bit. One type of jet drill that may be used can change direction of drilling by controlling pressure at the bit.

23 Claims, 3 Drawing Sheets

U.S. PATENT DOCUMENTS

| | | | | |
|---|---|---|---|---|
| 5,183,111 | | 2/1993 | Schellstede . | |
| 5,230,388 | * | 7/1993 | Cherrington | 175/53 |
| 5,269,384 | * | 12/1993 | Cherrington | 175/53 |
| 5,291,956 | | 3/1994 | Mueller et al. . | |
| 5,413,184 | | 5/1995 | Landers . | |
| 5,445,220 | | 8/1995 | Gurevich et al. . | |
| 5,469,925 | | 11/1995 | Mueller et al. . | |
| 5,477,923 | | 12/1995 | Jordan, Jr. et al. . | |
| 5,553,680 | | 9/1996 | Hathway . | |
| 5,570,712 | | 11/1996 | Mathieus . | |
| 5,617,886 | | 4/1997 | Mathieus . | |
| 5,765,756 | | 6/1998 | Jordan et al. . | |
| 5,853,056 | | 12/1998 | Landers . | |
| 5,879,057 | | 3/1999 | Schwoebel et al. . | |
| 5,934,390 | | 8/1999 | Uthe . | |
| 6,167,968 | * | 1/2001 | Allarie et al. | 166/298 |

* cited by examiner

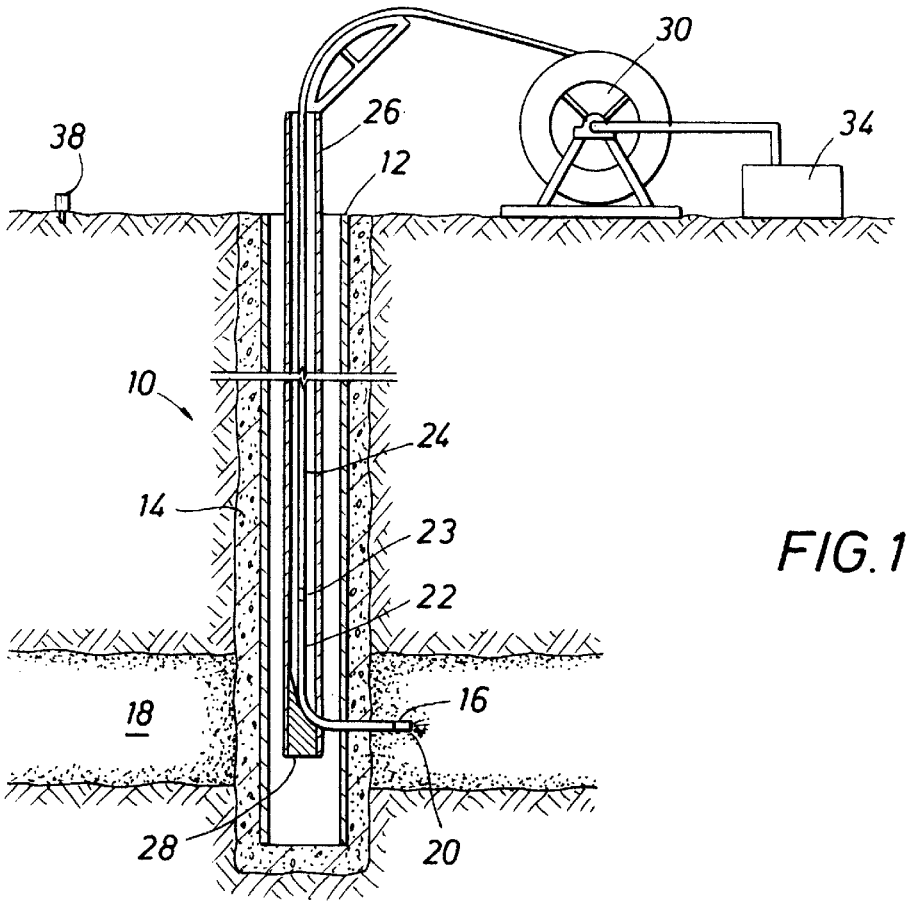
FIG. 1
FIG. 2A
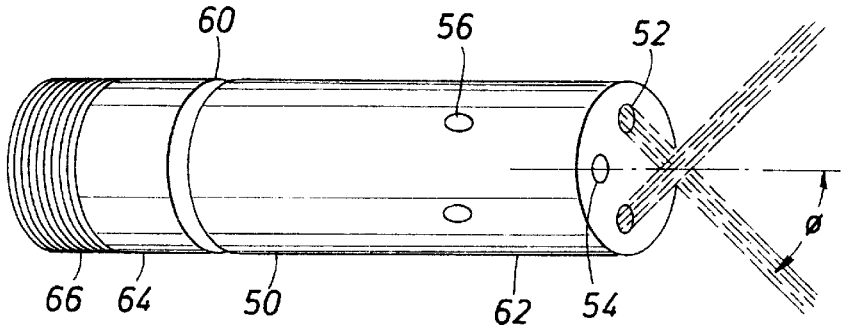
FIG. 2B
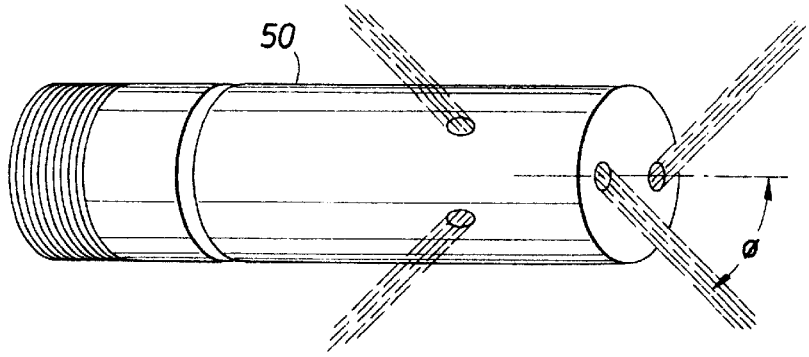

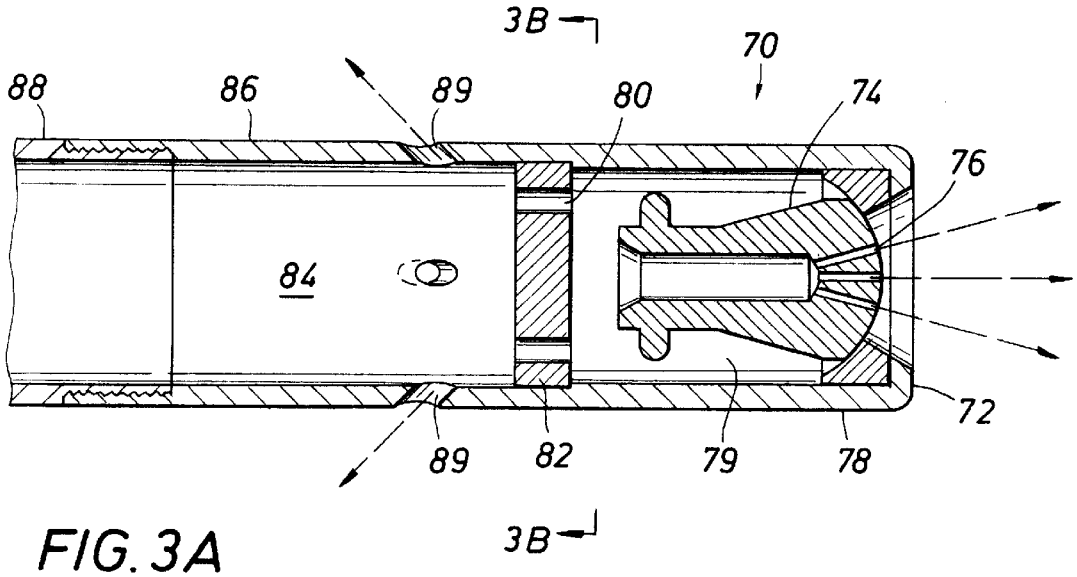
FIG. 3A
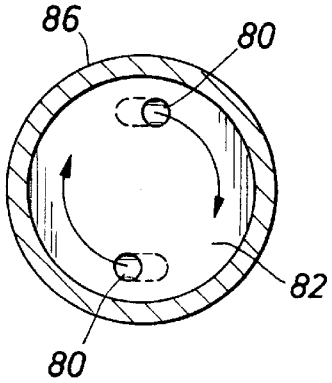
FIG. 3B
FIG. 4A
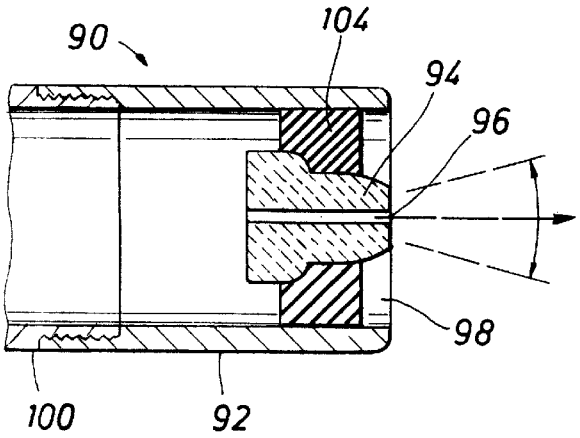
FIG. 4B
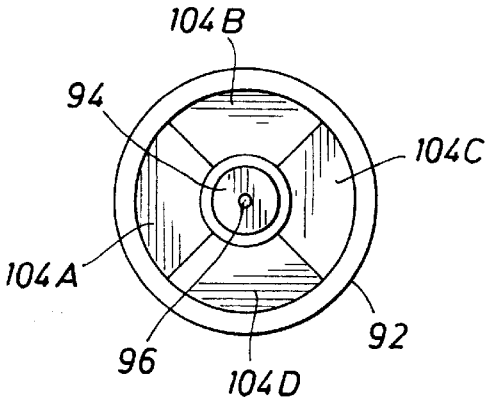

METHOD AND APPARATUS FOR JET DRILLING DRAINHOLES FROM WELLS

CROSS-REFERENCE TO RELATED APPLICATIONS

This application claims the benefit of U.S. Provisional Application No. 60/143,316, filed Jul. 12, 1999, and U.S. Provisional Application No. 60/120,731, filed Feb. 18, 1999.

BACKGROUND OF THE INVENTION

1. Field of the Invention

This invention pertains to drilling through the earth. More particularly, method and apparatus are provided for drilling through casings and then drilling extended drainholes from wells.

2. Description of Related Art

Oil and gas wells are normally drilled vertically from the surface of the earth to the depth of an oil or gas reservoir using a rotary drill. Metal casing is then placed in the wells and cemented in place. The metal casing is usually from about 4½ inches to 8 inches in diameter. Although most wells are vertical, in recent years wells drilled in a horizontal direction have become common.

It is known to drill drainholes from a larger wellbore for the purpose of increasing production rate of oil or gas from a well. (Karlsson and Bitto, *World Oil*, p. 51 ff, March 1989) Drainholes have been used as alternatives to other techniques, such as hydraulic fracturing, for enhancing production rate of oil or gas from wells. The direction of hydraulic fractures is controlled by stresses in the earth, and the direction in a particular reservoir may not be optimal for recovering hydrocarbons. Drainholes, however, can be drilled in a selected direction. This may be particularly advantageous when natural fractures are present in a hydrocarbon reservoir or for other reasons. (Kulch, *World Oil*, p. 47 ff, September 1990).

Significant developments have occurred in recent decades concerning the understanding, improved efficiency, and better methods for using jet drills for cutting rock. U.S. Pat. No. 4,119,160 discloses an apparatus and method that uses two nozzle jets, one axially straight ahead and the other at an angle of 30 degrees with respect to straight ahead. The nozzle is mechanically rotated. Compared to a single jet, this rotating two-jet arrangement cuts much more rapidly and efficiently. In their attempt to prevent contact of the central cone of the drill by adding a small 0.02 inch central orifice, they observed a huge 750% increase of rock removal with only a 25% increase in fluid flow rate. They performed experiments on harder rock specimens and concluded that the uniaxial compressive strength of the rock is not an adequate measure of its cuttability by water jets. U.S. Pat. 4,346,761 discloses an apparatus using high-pressure (about 3,000 psi) abrasive fluid jets to perforate steel casings. Extension of the jets into the reservoir is limited. U.S. Pat. No. 5,291,956 discloses a low-cost method of drilling and completing wells using a nonrotating jet drilling tool and coiled tubing. It uses a pipe assembly including a rigid bent pipe capable of plastically deforming the tube when the tube is forced from a first end to a second end of the bent pipe. A residual bend-remover straightens the stainless steel coiled tubing as it passes through the tube and into the formation. U.S. Pat. Nos. 5,413,184 and 5,853,056 disclose method and apparatus for penetrating a well casing and the surrounding earth strata. Rotary drilling using a ball drill and a hydraulic motor penetrates the casing. This equipment is then withdrawn from the well and a flexible tube with a nozzle on its end is inserted into the well to drill a horizontal extension into the reservoir. It is necessary to reinsert the jet drill in the hole originally made by the ball cutter.

What is needed is apparatus and method for perforating the casing and continuing to drill rapidly an extended lateral borehole or drainhole into the reservoir. Further, control of the direction of a jet drill as it drills through the reservoir and a method for measuring or detecting the location of the drill are significant improvements.

BRIEF SUMMARY OF THE INVENTION

Nozzle jets for drilling using an elastomeric tube that can turn through 90 degrees within a small radius in a casing are provided. In one embodiment, the jets have a plurality of orifices in the forward direction and a plurality of orifices extended backward along a drilled hole. In another embodiment the drill is made up of two compartments, and a compartment having forward facing orifices rotates with respect to a back compartment. In another embodiment the jets in the forward direction are caused to wobble by fluid action within the drill. And in yet another embodiment the jets in the forward direction are caused to change to different directions with respect to the axis of the drill by applying varying hydraulic pressure in the drill.

Drilling apparatus is provided containing the various embodiments of nozzles, elastomeric and nonelastomeric tubes and a drill guide. Drilling methods are provided using the disclosed nozzles. In one embodiment, abrasive particles are added to the drilling fluid as drilling commences through the wall of the casing and/or when hard rock is being drilled. A bit guide for determining direction perpendicular to the wellbore and diverting a drill bit in that direction may be attached to a tubing or may be wire line set. Drilling fluids may include polymer solutions in water. Location of the bit in the formation around the wellbore may be determined using acoustical techniques. Direction of the drill bit may be determined using directional instruments such as a magnetometer, gyroscope or accelerometer(s).

DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 1 illustrates a cased well and a drilling apparatus provided herein for drilling through a casing and drilling a drainhole in a reservoir.

FIGS. 2A through 2G illustrate views of drills. FIGS. 2A and 2B illustrate embodiments of a jet drill having a rotating segment as provided herein and different numbers of forward jets. FIG. 2C illustrates a cross-section of the drill. FIGS. 2D, 2E and 2F are cross-sections shown in FIG. 2C. FIG. 2F illustrates the end view of the drill of FIG. 2A and FIG. 2G illustrates the end view of the drill of FIG. 2B.

FIG. 3A illustrates an embodiment of a jet drill providing a wobbling movement of an insert containing orifices to produce rotary jets in the front. FIG. 3B is a cross-section of apparatus shown in FIG. 3A that illustrates the slanted angle of orifices through a partition and swirling of the fluid.

FIG. 4A illustrates a pressure-activated directional nozzle.

FIG. 4B illustrates the front view of the drill shown in FIG. 4A.

DETAILED DESCRIPTION OF THE INVENTION

Figure 2C:
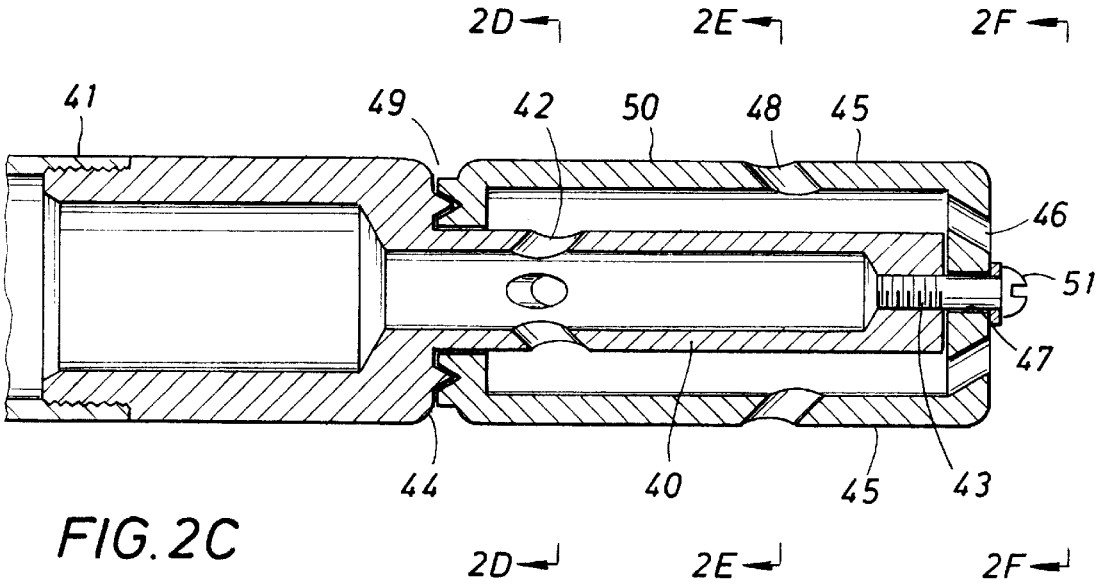

Referring to FIG. 1, one embodiment of drilling apparatus disclosed herein being used in well 10 is illustrated. Nozzle jet drill 20 has been used to drill through casing 12 and cement 14 and is used to continue drilling lateral hole or drainhole 16 through reservoir 18.

Nozzle jet drill 20 is attached to elastomeric tube 22, which in turn is connected to flexible steel tube (coiled tubing) 24 at connection 23. Upset tubing (rigid) 26 may be used to place bit diverter 28 in the well. The bit diverter is designed to turn a jet bit attached to an elastomeric tube through about a 90 degree turn, more or less. Diverter 28 may be a funnel tube guide which contains a wider top and narrows down to an outlet hole at the bottom, where a constriction (not shown) may be placed to enable a drill to kick-off. Alternatively, diverter 28 may be placed in casing 12 using well known wire line placement methods without the use of upset tubing 26 in the well. A recessed replaceable blasting plate (not shown) made of hard material such as tungsten carbide or the like, may be used to protect the funnel tube guide during the initial drilling through the wall of casing 12. Coiled tubing 24 extends to the top of well 10 and may coil onto reel 30.

Drilling fluid may be pumped down the well by pump 34. Drilling fluid may contain abrasive particles, preferably ranging from about mesh 60 to about mesh 140. A water-soluble polymer such as J362, available from Dowell/Schlumberger, may be used in the concentration range of about 10 pounds to about 40 pounds per 1,000 gallons of liquid to keep the abrasive particles suspended and to lower friction pressure loss during flow of drilling fluid through tubing 22 and 24. Concentration of abrasive particles may be selected depending on drilling conditions, but normally concentrations up to about one-half pound of abrasive per gallon may be used. Chemicals such as KCl and HCl may be added to drilling fluid to assure that the fluid is compatible with the reservoir. Preferably, the fluid pumped is filtered to minimize plugging of orifices in a bit and fluid may be heated to decrease friction loss during flow downhole. Flow rate of drilling fluid may vary widely, but may be, for example, about 8 gallons per minute A suitable high-pressure pump such as pump 34 is a Kerr Pump, such as KP-3300XP, of triplex design with ceramic plungers. It will provide over 4,000 psi at rates from 4.8 GPM to 21.5 GPM. A 24-horsepower unit should suffice for most shallow-well applications, that is, for well depths less than 2500 feet. Elastomeric tube 22 may be a Gates Rubber Company 6M2T product, product number 4657-1554, which has a minimum burst pressure of 16,000 psi, an inner diameter of 0.375 inch, and outer diameter of 0.69 inch, and a minimum bend radius of 2.5 inches. Other such tubes may be used having higher pressure ratings and smaller minimum bend radius. An intermittent pressure valve may be placed downstream of pump 34 to enable the introduction of pressure pulses into the drilling fluid that will be transmitted to drill 20. The pulsed pressure waves from the drill may be detected at the surface or in the bore hole by geophones 38 and used to monitor the position of drill 20, using known techniques. Direction-indicating instruments such as a gyroscope, magnetometer or accelerometer(s) or combinations of these instruments may be placed near bit 20 and information from such measurements may be transmitted to surface while drilling using known measurement-while-drilling (MWD) techniques, such that the operator is informed of the initial direction of the nozzle-jet into the formation and its subsequent direction. Normally, the operator will desire to maintain lateral hole 16 within reservoir 18 as drilling proceeds.

In one embodiment, bit diverter 28 is installed onto the bottom of the upset tubing. Tubing 26 is lowered to a selected depth and may be turned to the desired direction for penetrating casing 12. Direction of diverter 28 may be determined using gyroscopic or other known techniques, either attached to tubing 26 or run on wire line and retrieved. Nozzle jet drill 20 may be threadably attached to a length of elastomeric tube 22, typically 0.375 inch inner diameter or smaller hydraulic hose capable of withstanding pressures up to 4500 psi. Alternatively, elastomeric tube may be 0.25-inch diameter KEVLAR tubing. The length of elastomeric tubing 22 determines the maximum distance the lateral drainhole 16 can be drilled from the well 10. Elastomeric tube 22 is joined to coiled tubing 24 and may be wound onto reel 30. Drill 20 is attached to elastomeric tubing 22 and they are lowered into upset tubing 26 if it is present in the well. If it is not present, drill diverter 28 is set by wire line, using techniques well known in industry, and drill 20 is lowered down casing 12. When drill 20 enters the outlet of bit diverter 28, pump 34 is activated and drilling fluid, preferably containing abrasive particles, is pumped for several minutes at a pump pressure of up to about 4500 psi. Elastomeric tube 22 is a little taut because jet drill 20 has a momentum push against bit diverter 28. After casing 12 is perforated, drill 20 will enter reservoir 18 and continue drilling for a short distance using the abrasive liquid. After drilling about one foot, for example, into reservoir 18 a drilling fluid without abrasive particles may be used.

Whenever the rate of penetration of jet drill 20 is less than desired or becomes very slow, drilling fluid containing abrasive particles may be used. Once drainhole 16 has reached its predetermined length, pumping is stopped and coiled tubing 24 and elastomeric tubing 22 are reeled in. Upset tubing 26, if it is present, can then be turned and the whole process can be repeated to drill another lateral in another azimuth direction. This of course can be repeated many times at each level and in many reservoirs intersecting well 10.

A mild steel casing having a wall thickness of 0.244 inches was drilled with water containing silica sand with particle sizes about 60-mesh at a concentration of about 1 pound per gallon. By using a rate of flow of 3 gallons per minute and a pressure of 3,000 psi, a hole was drilled through the casing in less than five minutes. By adding hydrochloric acid to obtain a 2% hydrochloric acid solution, the abrasive jet cut the mild steel even faster. Using the above apparatus, we drilled a 3-inch hole through limestone in about 18 seconds.

A stationary nozzle jet having an orifice diameter of 0.021 inch was placed close to a piece of low-porosity limestone and water was pumped through the orifice at a pressure of 4,000 psi. After pumping for five minutes, only a small indentation was present on the surface of the limestone. By using Dowell Gelling Agent J362 with ¼ pound per gallon of 120 mesh silica sand, a 0.025-inch orifice and a pressure of less than 1,000 psi, holes over 1 inch deep in the limestone were drilled in less than two minutes. The above experiments illustrate the feasibility of using abrasive sand and a nozzle-jet drill to drill through the casing and through even a low porosity limestone reservoir. With high-porosity limestone, as associated with oil and gas reservoirs, rapid cutting of the rock with a nozzle-jet drill even without the abrasive particles present in the drilling fluid will occur. The above experiments were conducted using fixed jets.

One embodiment of a nozzle jet drill for drilling drainholes is illustrated in FIGS. 2A and 2B. A rotating drill is generally shown at 50. Drill 50 has forward orifices 52 and 54. These orifices can produce jets directed forward of the drill. Orifices 52 produce jets crossing in front of the drill and orifices 54 produce jets that diverge from the axis of the drill. In addition, orifices 56 produce jets directed backward from the direction of travel of the bit while drilling. Slip rings, roller or journal bearing or other rotation mechanism 60 is used to allow front shell 62 of bit 50 to rotate with reference to back shell 64. Back shell 64 has connector 66 integral or affixed thereto. The diameter of bit 50 may be in the range from about 0.3 inches to about 0.7 inches, and it may have a total length less than 1 inch. If desired, a stabilizer may be attached to increase length, the maximum length being still short enough to enter the drainhole to be drilled from inside the casing of a well. Orifices 52 may be about 0.2 inches apart and are diametrically opposite each other on the front of drill 50 and are oriented such that the jets from the orifices are oriented toward the axis of the bit, preferably making an angle of less than 30 degrees with respect to the longitudinal axis of the drill. These orifices may be also oriented such that the jets cross each other about 0.1 inch apart, which causes them to provide a recoil back on the drill 50 and a small torque, which tends to turn the front of the drill 50 in the clockwise direction when viewing the drill from behind. Orifices 54 are about 0.2 inches apart and have diameters of about 0.02 to about 0.03 inches. The jets are oriented at an outward angle $\Phi$ with respect to the longitudinal central axis of the drill and may be in a direction that tends to turn the drill in the clockwise direction when viewed from in front of the drill. Orifices 56 exist to provide torque on forward shell 62 to turn the drill shell and to provide a forward thrust to the bit when fluid is pumped through the bit. By being slanted at an angle with respect the axis and toward the rear of the drill and an angle with respect to a tangential line perpendicular to the axis of the nozzle jet, orifices 56 produce jets imparting a forward thrust on the bit and a torque to turn the forward shell of the bit. The diameters of orifices 56 will typically be from about 0.03 inches to about 0.04 inches in diameter. By picking particular angles for the orifices 56, enough thrust is available to produce rather high-speed rotation of forward shell 62 and several pounds of forward thrust can be obtained as fluid is pumped through the drill at high pressure. This enables the front jets to spallate the rock in front and the back jets to widen the hole made by the front jets of the drill and to carry the spallated material to the borehole.

FIG. 2C illustrates an alternate embodiment of a rotating drill bit 50 that has hollow shaft 40 with a longitudinal center axis, being threaded axially to form threads 43 at one end to allow use of a screw and washer 51 as guidance members for hollow shaft 40. Hollow shaft 40 is formed from a first shell and fluid inlet connector 41 may be attached at the backward end of the shell. Holes 42 between the inside and the outside of the hollow shaft 40 may be placed near the center of its length. Elevated ridge stop 44 is on the back portion of the hollow shaft 40. Shell 45 slides onto the hollow shaft 40 such that it can rotate while mounted on the shaft. Back 49 of the shell 45 is adapted to fit with ridge 44 of hollow shaft 40 to form a rotation mechanism by surface to surface slippage. A variety of rotation mechanisms may be used, such as bearings or other known rotation mechanisms. Front hole 47 in shell 45 lines up with the hole in the center of the hollow shaft 40. The inner diameter of shell 45 is greater than the outer diameter of the hollow shaft 40 to form a chamber therebetween. Shell 45 slides onto shaft 40 and is attached at the threaded end 43 of the shaft 40, shown in the diagram as washer and screw 51, which form a guide mechanism and provide for rotation of one shell with respect to the other. Back 49 of shell 45 and the washer and front surface of the shell may be lubricated with a high-temperature graphite lubricant such as Mobil synthetic 1090, product 60188-4, to reduce the friction between the shell 45 and the other components. High pressure fluid flows through fluid connector 41, through a portion of the hollow shaft 40, through holes 42 and into the shell 45 and through orifices 46 on the front of shell 45 and through the orifices 48 in shell 45 to produce jets toward the back. Since the area on the inside front of shell 45 is about the same as the area on the rear surface of shell 45 and the pressure is about the same in the shell 45, the net force forward on shell 45 is equal to the net force backwards on shell 45 due to the internal fluid, even for high applied pressures. This low frictional force reduces the heat generated at the surfaces and allows rather high rotation rates to be obtained. The plurality of front orifices 46 typically have diameters in the range of 0.015 to 0.030 inches, are directed at an angle in the range from 0 to 30 degrees with respect to the longitudinal axis and are disposed to produce non-interacting jets. Backward orifices 48, typically having diameters in the range of about 0.025 inch to about 0.04 inch, are sized so as to cause forward thrust on the bit when fluid is pumped through the bit. At least one of the forward or backward orifices is preferably directed so as to cause rotation of shell 45 as fluid is pumped through the bit. This design allows a wide range of revolution rates from a small rpm to thousands of rpm. Drill 50 may have a diameter less than 0.7 inches and a length of one inch or less. When mounted on the elastomeric tube, it is capable of making a 90° turn in a 4.5-inch standard oilfield casing to bore horizontal drainholes.

Figure 2D:
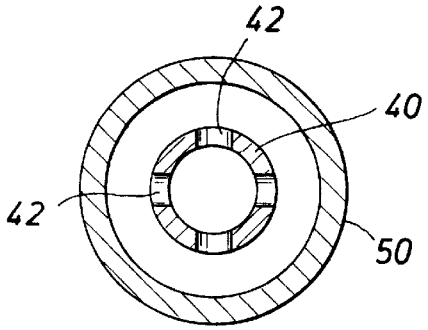
Figure 2E:
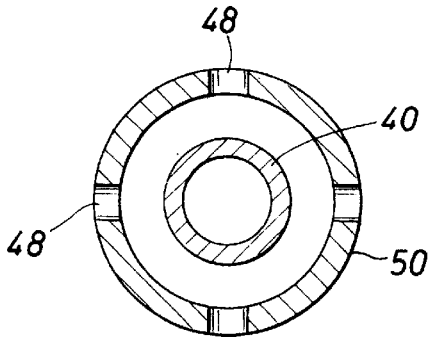
Figure 2F:
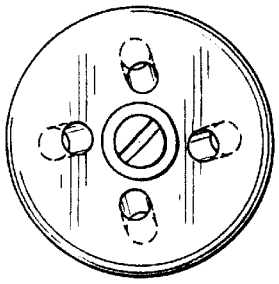
Figure 2G:
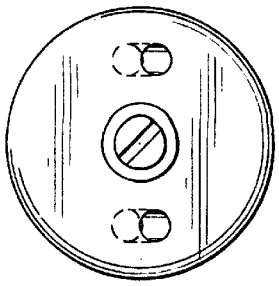

FIGS. 2D and 2E and 2F show the cross-sections indicated in FIG. 2C. FIG. 2G illustrates the front of FIG. 2C when only two forward-facing orifices are present.

An alternate embodiment of a jet drill is illustrated in FIG. 3A. A wobbling orifice drill is generally illustrated at 70. Drill 70 typically has an outer diameter of less than 0.7 inch and a length of about 1 inch. Front face 72 of drill 70 is made of a very hard material such as hard steel or tungsten carbide to make the front very resistant to abrasion and wear. Orifice insert 74 includes forward orifices 76, which may be made of ceramic, tungsten carbide, or sapphire. Insert 74 can wobble at the front and still maintain a fluid-tight seal around orifices 76. One orifice may be axially located and others may be located at predetermined orientations with respect to the axis. Front shell 78 encloses front compartment 79. Drilling fluid enters compartment 79 through orifices 80 in partition 82 between front compartment 79 and back compartment 84, which is enclosed by back shell 86. Fastener 88, which may be a threaded connection, is integral with or affixed to back shell 86. Orifices 80 are oriented tangential to the inner edge of front compartment 79 so that the fluid flowing from the back compartment to the front compartment of the nozzle causes ceramic insert 74 to wobble, which produces a cutting effect similar to rotary motion of forward orifices. Some of the fluid entering nozzle drill 70 exits through a plurality of orifices 89 that are oriented toward the rear of the nozzle to propel the nozzle forward and also to widen the hole cut by the front jets of the drill. Insert 74 may be replaced when front orifices 76 are widened and cutting efficiency is reduced. Frontward and backward orifices are sized to insure that a forward thrust is imparted to bit 70 when fluid is pumped through the bit. FIG. 3B illustrates the cross-section indicated in FIG. 3A.

In another embodiment of a jet drill or bit, control of the direction of the boring of a drill in a reservoir or other segment of the earth is provided. FIG. 4A is a cross-sectional view of a bit, shown generally at 90, having an orifice that can be changed in direction. Shell 92, typically made of stainless steel, and ceramic insert 94, which contains one or more orifices 96, and ceramic seat 98, which is attached to the front of shell 92, allows ceramic insert 94 to wobble and still maintain contact at the front so that liquid is emitted only through the orifice (more typically orifices) 96. When the orifices in ceramic insert 94 are degraded by high-pressure liquid and /or abrasive slurry, the insert may be exchanged for a new insert at a cost much less than the cost of a new bit. Ceramic inserts such as insert 94 can be mass-produced very economically. Connector 100 may be threads or any other type hydraulic connector. FIG. 4B is a front view of ceramic insert 94 with only one straight orifice 96 located on the axial center of the insert. Many orifices, in many different directions, can be drilled through a ceramic insert using high-pressure water jets. A curved front of ceramic insert 94 fits into the ceramic seat 98 in such a manner that the insert can wobble through a given angle to cause the orifice (or orifices) 96, and hence the jets issuing therefrom, to change direction and yet maintain good contact and emit fluid, for practical purposes, only through orifices 96. Elastomeric substances 104 are placed between ceramic insert 94 and seat 98 and shell 92 such that the direction of insert 94 is changed when different hydrostatic pressures are applied inside nozzle 90. For example, four elastomeric materials having four different compressibility values may be placed in four quadrants around insert 94, as shown in FIG. 4B. As pressure increases, the compression for the elastomeric materials 104A, 104B, 104C and 104D in different quadrants will change. This will change the orientation of the orifices. The elastomeric materials may be selected so that when 4000 psi or greater is applied to the nozzle jet drill, all elastomeric materials are totally compressed and the jet shoots straight ahead. When the pressure is reduced to 3,500 psi, for example, one of the materials, 104C for example, may expand more than others and cause ceramic insert 94 to wobble and the jet to shoot toward the left. If the pressure is further reduced to 3000 psi, then another elastomeric material, say 104B, may expand and the change in compression may cause the jet to shoot in the left and upward direction. By employing elastomers with appropriate spring constants, the direction of the nozzle jet can be controlled by controlling the applied pressure to the nozzle. The pressure to the nozzle can be controlled to within 500 psi. Many elastomers may be used and a number of small bores can be made in an elastomer to reduce the spring constant of each elastomer U.S. Pat. No. 5,906,887, which is incorporated by reference herein, tells of a method to use tacky rubbery substances that include either a high density of solid microspheres or a low density of microspheres, the spring constant being greater for the high density of microspheres. The elastomeric material may have a thickness from about 2 millimeters to about 20 millimeters and may serve as a resilient shock absorber.

Sound/ultrasound sensors or geophones 38 at the surface of the earth and/or in the borehole (FIG. 1) allow determination of the location of the jet drill. Pressure pulses may be introduced into the drilling fluid to enhance acoustic signals from the bit. By adjusting the pressure level at the bit and detecting acoustic signals from the bit, the direction of the drill in the reservoir can be determined and controlled. The bit usually should remain in the reservoir and not drill into an adjoining stratum during drilling.

EXAMPLE

A nozzle-jet bit has one orifice on the longitudinal axis of the bit with an inner diameter of 0.019 inches. Three other orifices, each with inner diameter of 0.021 inches, on the front equidistantly spaced make an angle of +30 degrees with respect to the axis of the bit. There are four orifices, each having an inner diameter of 0.026 inch, and the jets from these orifices are in the rear direction at an angle of 30 degrees with respect to the longitudinal axis. According to tables for the flow rate of water at 20° C. with a differential pressure of about 4,000 psi, the flow rate will be about 0.5 gallons per minute (GPM) through the 0.019 inch diameter orifice, 0.7 GPM through each 0.021 inch diameter orifice, and 1.1 GPM through each 0.026 inch orifice. Hence, the total flow rate from the bit is 7.0 GPM. Calculations of pressure drop in tubing show that pressure drop will not be excessive to well depths of at least 4,000 feet when such flow rates required for the nozzle-jet drills are used. Polymers can be added to the drilling fluid to decrease friction pressure drop in tubing if needed, as is well known in industry. If necessary to remove cuttings, the drill bit can be removed from a hole and the elastomeric tubing can be used open-ended to wash cuttings from the hole.

The theoretical recoil force due to water jet flow is given by the following, where for the reactive force we take (+) to be straight ahead and (−) is in the backwards direction.

Recoil force (pounds of force, lbf)=(0.0526) (×GPM) (differential pressure across orifice)$^{1/2}$ Recoil force for straight ahead orifice=−(0.0526) (0.5 GPM) (4,000 psi)$^{1/2}$=−1.7 lbf Recoil force for three other front orifices=−(0.0526)×(3) (0.7 GPM)(4,000 psi)$^{1/2}$ cos 30°=−6.0 lbf.

Recoil force for four rear jets=(0.0526)×(4) (1.1 GPM)(4,000 psi)$^{1/2}$ cos 30°=+12.7 lbf The net forward force is then=12.7 lbf−1.7 lbf−6.0 lbf=+5 lbf.

Hence, a five-pound force forward is acting on the drill. If one desires to obtain more thrust on the nozzle, the diameter of the rear orifices can be increased and slanted more toward the rear to substantially increase the forward thrust on the drill. Therefore, the drill can be operated on the end of an elastomeric tubing that can be deflected in a short radius inside casing to drill through the wall of the casing, using abrasive particles in the fluid, and into a reservoir. Drilling can then be continued with the same bit in the reservoir. This method and apparatus therefore offers significant advantages over prior art methods of drilling drainholes from wells. Of course, the method can be used when casing is not present at the depth where the drainhole is to be drilled. Also, the method can be used to drill drainholes from wells that exist at any angle. For example, the method can be used to drill drainholes from horizontal wells.

It will now be seen that a new and improved method and apparatus which uses solid particles in a fluid, a nozzle jet drill, and a small diameter elastomeric tube enables one to continuously drill through a casing and drill a lateral borehole of length of 200 feet and beyond. The initial direction of the jet drill into the formation may be determined by the use of a gyroscope. Spatially placed acoustic detectors detect the sound/ultrasound produced by the jet drill in the formation to allow determination of the position and velocity of the jet drill in the formation. A pressure activated nozzle jet drill enables an operator at the surface to control the direction of the jet drill in the formation by controlling the applied pressure.

It is realized that while the preferred embodiment of the invention has been disclosed herein, further modifications to the preferred embodiment will occur to those skilled in the art and such obvious modifications are intended to be within the scope and spirit of the present invention.

What is claimed is:

1. A drill bit for jet drilling in the earth, comprising:

a first shell having a forward end and backward end and a longitudinal axis, the first shell forming a first chamber and having a fluid connector affixed to the backward end of the shell;

a second shell having a forward end and a backward end and a longitudinal axis, the second shell forming a second chamber;

a rotation mechanism disposed between the forward end of the first shell and the backward end of the second shell to allow relative rotation between the first shell and the second shell;

a plurality of forward orifices extending from the second chamber through the forward end; and a plurality of backward orifices directed from the second shell toward the backward end of the shell, the orifices being sized so as to cause a forward thrust on the bit when fluid is pumped through the bit and at least one of the forward or backward orifices being directed so as to cause rotation of the second shell when fluid is pumped through the orifices.

2. The drill bit of claim 1 wherein the forward orifices have a diameter in the range from about 0.015 to about 0.030 inch and are directed at an angle in the range from about 0 to about 30 degrees from the longitudinal axis.

3. The drill bit of claim 1 wherein the forward orifices are disposed to produce non-intersecting jets therefrom when fluid is pumped through the bit.

4. The drill bit of claim 1 wherein the first shell and the second shell have a diameter in the range from about ⅜ to about ¾ inch and a total length in the range from about ¾ inch to about 1½ inch.

5. A drill bit for jet drilling in the earth, comprising:

a first shell having a forward end and backward end and a longitudinal axis, the first shell having a fluid connector affixed to the backward end of the shell and forming a hollow shaft toward the forward end, the hollow shaft having orifices through the shell along the hollow shaft;

a second shell having a forward end and a backward end and a longitudinal axis, the second shell having a diameter adapted to form a chamber between the hollow shaft and the second shell, the backward end of the second shell being adapted to form a rotation mechanism between the first shell and the backward end of the second shell;

a guidance member for aligning the hollow shaft in the second shell and to provide for rotation of the second shell with respect to the first shell; and front orifices and backward orifices in the second shell, the orifices having a size so as to cause a forward thrust on the bit when fluid is pumped through the bit.

6. The bit of claim 5 wherein the front orifices in the second shell have a diameter in the range from about 0.015 to about 0.030 inch.

7. The bit of claim 5 wherein the front orifices in the second shell are directed at an angle in the range from about 0 to about 30 degrees from the longitudinal axis of the insert and are disposed to produce non-intersecting jets therefrom.

8. The bit of claim 5 wherein the rotation mechanism is an elevated ridge stop in the first shell and a matching surface in the second shell, the matching surface being adapted to slide on the ridge stop.

9. A drill bit for jet drilling in the earth, comprising:

a shell having a forward end and backward end and a longitudinal axis, the shell having a fluid connector affixed to the backward end of the shell and a seat affixed to the forward end of the shell, the seat having an opening therethrough;

an elongated orifice insert having an outside surface and a longitudinal axis, the outside surface having a forward end and a backward end, the forward end of the outside surface forming a seat adapted to contact the seat affixed to the shell and having one or more orifices therethrough, the backward end being open so as to allow fluid to pass through the orifice insert to the orifices;

a partition between the forward end and the backward end of the shell to form a forward and a backward chamber, the partition having at least one orifice therein, the orifice being disposed so as to induce circular flow of fluid in the forward chamber and around the orifice insert; and backward orifices in the shell, the orifices having a size so as to cause a forward thrust on the bit when fluid is pumped through the bit.

10. The bit of claim 9 wherein the front orifices in the second shell have a diameter in the range from about 0.015 to about 0.030 inch.

11. The bit of claim 9 wherein the front orifices in the second shell are directed at an angle in the range from about 0 to about 30 degrees from the longitudinal axis of the insert and are disposed to produce non-intersecting jets therefrom.

12. A drill bit for jet drilling in the earth, comprising:

a shell having a forward end and backward end and a longitudinal axis, the shell having a fluid connector affixed to the backward end of the shell and a seat affixed to the forward end of the shell;

an insert having an outside surface, the outside surface having a forward end and a backward end, the forward end of the outside surface having a seat adapted to contact the seat affixed to the shell and forward orifices, the backward end having an opening so as to allow fluid to pass through the insert to the forward orifices;

a plurality of elastic materials between the outside surface of the insert and the shell, the elastic materials having a compressibility, the compressibility depending on total hydrostatic pressure around the elastic material; and at least two orifices in the shell, the orifices directed backward and having a size so as to cause a forward thrust on the bit when fluid is pumped through the bit.

13. Apparatus for drilling drainholes extending a selected distance from a well, comprising:

a pump;

a selected length of coiled tubing attached to the pump;

an elastomeric tubing having a length at least as long as the selected distance to be drilled and being attached to the coiled tubing; and a drill bit for-jet drilling in the earth attached to the elastomeric tubing, the bit having orifices disposed so as to form jets in a forward direction and in a backward direction and sized to produce a forward thrust on the bit when fluid is pumped through the bit.

14. A method for drilling drainholes extending a selected distance from a well drilled through an underground formation and having a casing, comprising:

providing a pump and a drilling fluid;

providing a selected length of coiled tubing and attaching the coiled tubing to the pump;

providing a length of elastomeric tubing having a length at least as long as the selected distance from the well to be drilled and attaching the elastomeric tubing to the coiled tubing;

attaching a drill bit for jet drilling to the elastomeric tubing, the bit having forward facing orifices and backward facing orifices, the orifices being sized so as to produce a thrust on the bit in the forward direction;

placing a bit diverter in the well at a selected location;

placing the bit, elastomeric tubing and coiled tubing in the well; and pumping the drilling fluid through the bit so as to drill through the casing and a selected distance into the formation.

15. The method of claim 14 wherein the bit diverter is placed in the well on an upset tubing string.

16. The method of claim 14 further comprising the step of placing geophones around the well and detecting acoustic waves to determine the location of the bit.

17. The method of claim 14 further comprising the step of placing a direction-indicating instrument in the well to determine the direction of the bit before or during drilling.

18. The method of claim 14 further comprising the step of adding abrasive particles to the drilling fluid.

19. The method of claim 18 wherein the step of adding abrasive particles is carried out while drilling the casing.

20. The method of claim 14 wherein the bit is the bit of claim 12 and pressure at the bit is changed to change direction of the bit during drilling.

21. The method of claim 14 wherein the bit is the bit of claim 1.

22. The method of claim 14 wherein the bit is the bit of claim 5.

23. The method of claim 14 wherein the bit is the bit of claim 9.

* * * * *